US005214954A

United States Patent [19]

Abbott et al.

[11] Patent Number: 5,214,954

[45] Date of Patent: Jun. 1, 1993

[54] PORTABLE BASKETBALL RIM TESTING DEVICE

[76] Inventors: W. Bruce Abbott, 610 Clover St., Cheney, Wash. 99004; Karl C. Davis, Box 722, Richland, Wash. 99352

[21] Appl. No.: 824,843

[22] Filed: Jan. 21, 1992

[51] Int. Cl.[5] ..... G01L 5/00

[52] U.S. Cl. ..... 73/12.01; 73/79

[58] Field of Search ..... 73/11, 12, 13, 78, 79, 73/844; 273/1.5 R

[56] References Cited

U.S. PATENT DOCUMENTS

| | | | |
|---|---|---|---|
| 2,587,628 | 3/1952 | King | 73/11 |
| 2,619,956 | 12/1952 | Torricelli | 128/2 |
| 2,740,287 | 4/1956 | Gindraux | 73/12 |
| 2,854,847 | 10/1958 | Brady | 73/100 |
| 2,888,821 | 6/1959 | Duffy, Jr. et al. | 73/4 |
| 2,923,147 | 2/1960 | MacMillan | 73/11 |
| 2,972,329 | 2/1961 | Smith | 116/114 |
| 3,214,966 | 11/1965 | Menzies | 73/79 |
| 3,349,620 | 10/1967 | Speiser | 73/379 |
| 3,552,184 | 1/1971 | Breese et al. | 73/12 |
| 3,811,316 | 5/1974 | Amendolia | 73/11 |
| 3,859,841 | 1/1975 | Evans et al. | 73/12 |
| 3,879,982 | 4/1975 | Schmidt | 73/12 |
| 3,981,174 | 9/1976 | Himmler | 73/11 |
| 4,006,626 | 2/1977 | Ruzicka et al. | 73/13 |
| 4,034,603 | 7/1977 | Leeb et al. | 73/79 |
| 4,426,875 | 1/1984 | Crosby, Jr. | 73/12 |
| 4,495,792 | 1/1985 | Bai et al. | 73/12 |
| 4,761,991 | 8/1988 | Fembock | 73/11 |
| 4,880,239 | 11/1989 | Leneveu | 273/181 |

OTHER PUBLICATIONS

"Rebound Tests on Various Basketball Rims," Q. C. Metallurgical Laboratory, Inc., Jun. 3, 1986.

"The 1989/1990 Basketball Equipment Report from The Research Committee of the National Association of Basketball Coaches," Apr. 1990, Denver, Colo.

"A Pilot Study for the Development of a Field Test for Basketball Rims," Jerry Krause & NABC Research Committee.

"The Effects of a Target Rim on Basketball Shooting Accuracy," Jerry Krause and Larry Sage, NABC Research Committee, 1985.

"An Equipment Research Project of Rims/Backboards/Support Systems," Jerry Krause and The National Association of Basketball Coaches Research Committee, Mar. 1985.

"Rim Elasticity Test," National Association of Basketball Coaches, Ronan and Kunzl Device, 1988.

Masters Thesis by W. Bruce Abbott titled "Impact Characteristics of the Karate Strike and Thrust Technique," (Aug. 1986), title page, pp. 19–22, 43 (photo), 44, and 51 (photos).

*Primary Examiner*—Donald O. Woodiel
*Assistant Examiner*—R. L. Biegel
*Attorney, Agent, or Firm*—Wells, St. John, Roberts, Gregory & Matkin

[57] ABSTRACT

A portable basketball rim rebound testing device 10 is illustrated in two preferred embodiments for testing the rebound or energy absorption characteristics of a basketball rim 12 and its accompanying support to determine likely rebound or energy absorption charcteristics of the system. The apparatus 10 includes a depending frame 28 having a C-clamp 36 for releasably rigidly connecting the frame to the basketball rim 12. A glide weight 60 is mounted on a guide rod 52 permitting the weight 60 to be dropped against a calibrated spring 56 held on an abutment surface on the rod to generate for deflecting the basketball rim and then rebounding the weight upwardly. A photosensor 66 is mounted on the depending frame 28 to sense passage of reflective surfaces 75 on the weight to thereby obtain sufficient data to enable a processing means 26 to calculate the rebound velocity and relate it to an energy absorption percentage rate of the rim system 12. A readout is provided to display the energy absorption percentage.

26 Claims, 11 Drawing Sheets

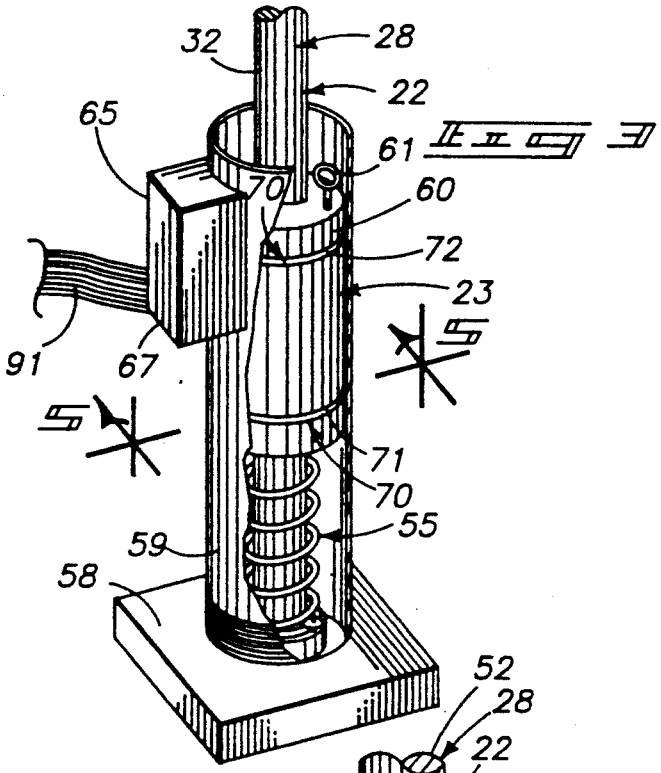
Fig 3
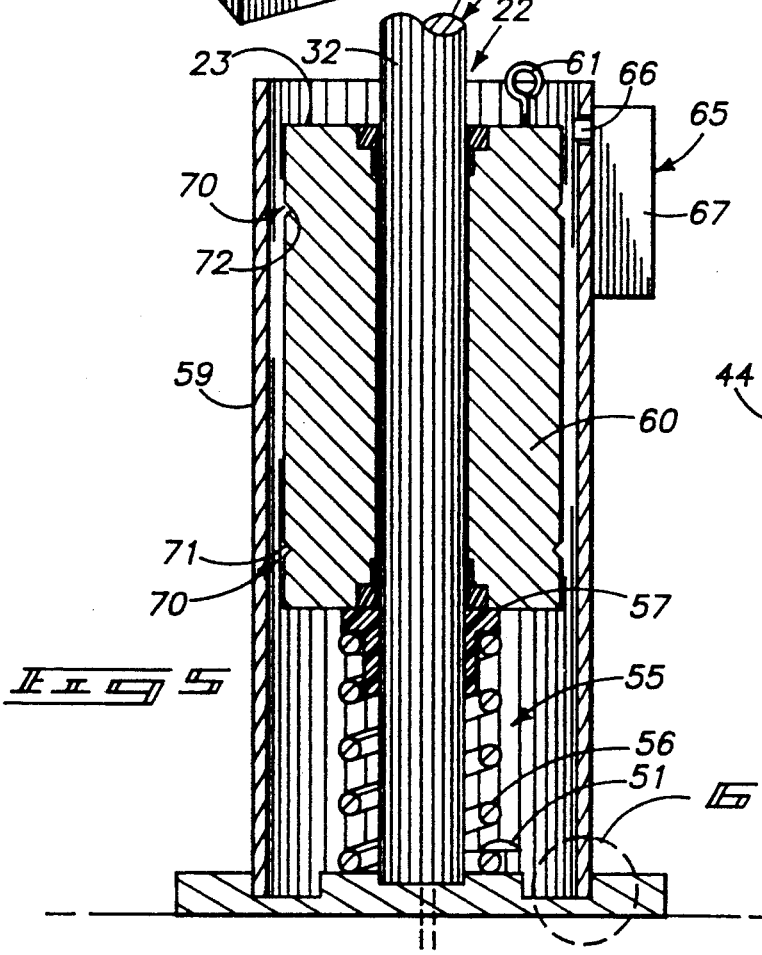
Fig 5
Fig 6
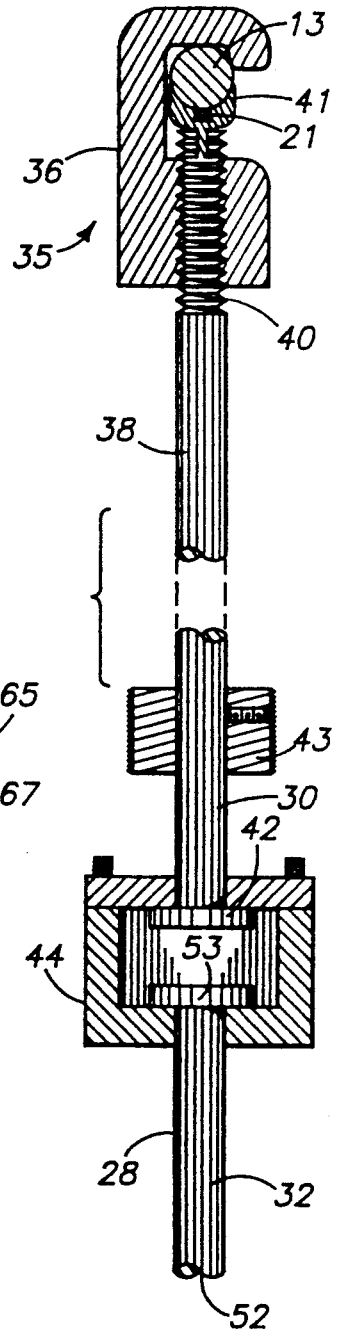
Fig 4

PORTABLE BASKETBALL RIM TESTING DEVICE

TECHNICAL FIELD

This invention relates to apparatus for determining basketball rim system rebound characteristics.

BACKGROUND OF THE INVENTION

It has been found that basketball rim rebound characteristics can have a significant impact on the "play" of the game of basketball. For example a "lively" basketball rim is more likely to bounce or rebound a basketball a substantial distance from the rim, whereas a "dead" basketball rim will cause the ball to rebound a shorter distance. Such different rebound characteristics must be determined by players before they are able to properly locate themselves under the basket. The "home" team, having already made this determination during practice and "home" games, has a marked advantage.

"Dead" basketball rims tend to increase the percentage of shots that pass through the goal. It has been observed that a game played utilizing "dead" basketball rims usually ends in a higher score than a game played with "lively" rims.

Lack of standardization in manufacturing of basketball rim systems including: (1) the rim material, (2) stress characteristics, (3) design, (4) connection with the backboard; and (5) the support system (ceiling, wall or floor), can all cause a substantial difference in the "play" of the game. For example, a team practicing on a basketball court having "dead" basketball rim systems will develop a particular successful shooting pattern. The same team playing on a court having "lively" basketball rims, will find the developed shooting patterns will not be nearly as effective.

Rebound characteristics may be an advantage to one team over another, depending upon player height. Generally a "dead" basketball rim favors a tall team with players that will cluster close to the rim to recapture the basketball when it rebounds. Whereas a "lively" basketball rim favors a team having shorter players spaced a further distance from the basketball rim.

Consequently, it is desirable to standardize rebound or energy absorption characteristics of rim systems so that the rebound "play" of the basketball is more uniform and does not give an undue advantage to the home team who would otherwise be much more accustomed to the rebound characteristics of the basketball rim system on their home court.

For the above reasons, there has been a long felt need for a rim testing apparatus for measuring basketball rebound or energy absorption characteristics to (1) determine rebound characteristics, and (2) to determine if the measured characteristics fall within a permitted standard, thereby avoiding the unfair "home team advantage".

Devices are known for testing the rebound characteristics of basketball rims. Most such prior devices are difficult to use, and have not been sufficiently useful to enable standard comparisons between rims. Prior apparatus also do not lend themselves to consistent testing and therefore will not obtain accurate and consistent information acceptable to coaching staffs of opposing teams and to game officials. Prior electro/mechanical apparatus have also been developed, but have been found to be quite expensive and overly sensitive.

The principle object and advantage of this invention therefore to overcome these particular problems and to provide a portable basketball rim testing device for testing the rebound or energy absorption characteristics of the basketball rim system at an attainable low cost, and that is easy to operate in a very efficient and reliable manner.

BRIEF DESCRIPTION OF THE DRAWINGS

The preferred embodiment of the invention is illustrated in the accompanying drawings, in which:

FIG. 3 is an fragmented isometric view of a portion of the device;

FIG. 4 is a fragmented exploded elevational sectioned view taken along line 4—4 in FIG. 2;

FIG. 5 is an enlarged sectioned view taken substantially along line 5—5 in FIG. 3;

FIG. 14 is an enlarged sectioned detail view of a hook member for the present device.

FIG. 16 is a schematic of the motion sensor employed in the embodiment shown in FIG. 15.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figures 1, 2:
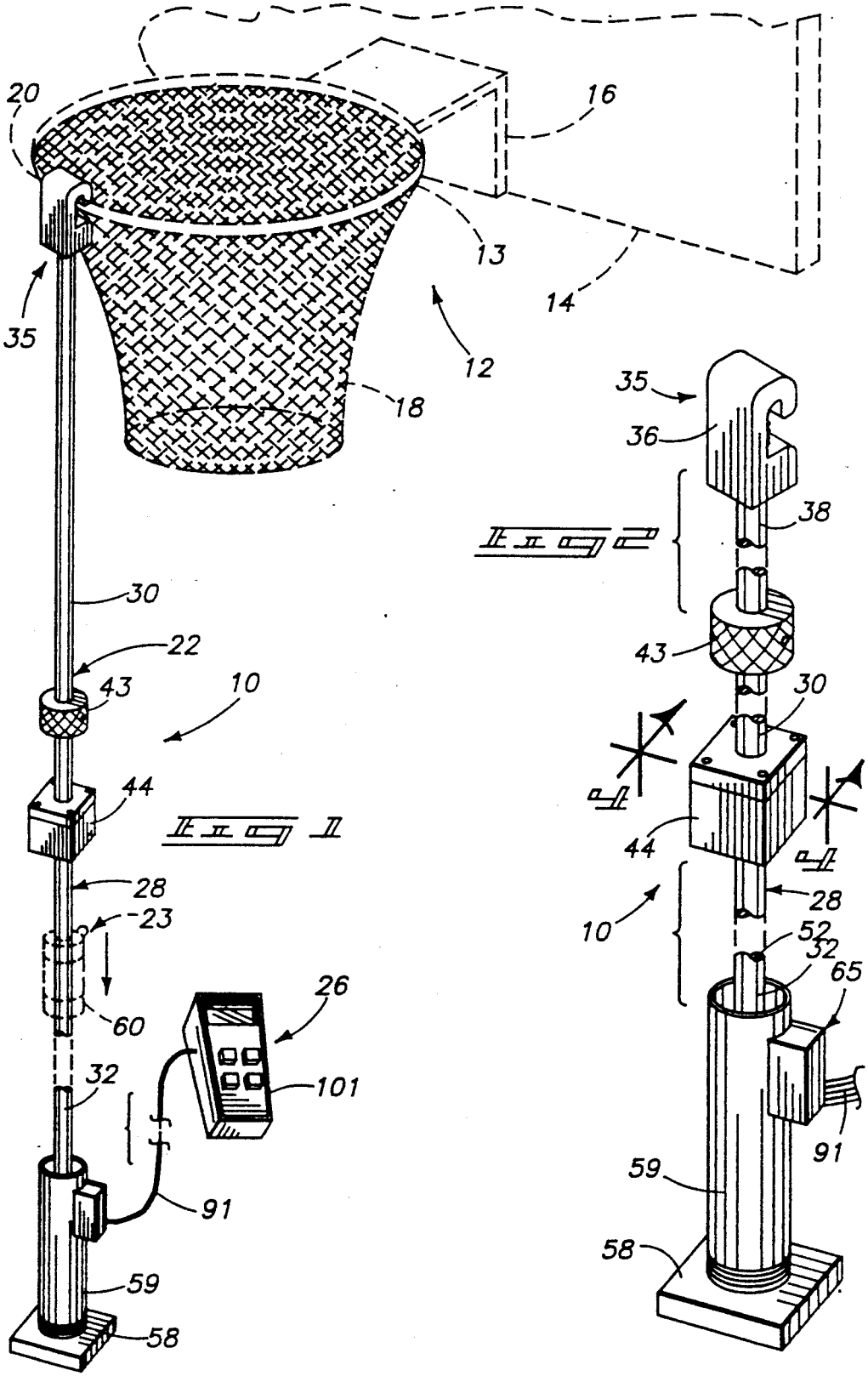
FIG. 1 is fragmented isometric view of a first preferred embodiment of the basketball rim testing device illustrating the device mounted to a basketball rim.
FIG. 2 is an enlarged fragmentary isometric view of the portable basketball rim testing device.

Referring to the drawings, there is illustrated in FIG. 1 a first preferred embodiment of a basketball rim rebound or energy absorption testing apparatus generally designated with the numeral 10 for determining the rebound or energy absorption characteristics of a basketball rim system 12. The basketball rim or rim system 12, as used herein should be taken as inclusive of the basketball rim 13, the backboard 14, the backstop support frame (not shown), and the floor, ceiling or wall support system (also not shown) that supports the basketball rim 13 in a cantilevered horizontal position.

Rebound or energy absorption characteristics vary with the type and rigidity of the rim support system 12.

For example, the basketball rim 13 and backboard 14 may be supported from a ceiling (not shown); from a wall; or from a floor standing support structure (also not shown). Frequently the basketball rim system 12 is portable so that it can be moved about on the basketball floor so that the basketball floor or gymnasium can be utilized for other events besides basketball. Each form of support system may alter the energy absorption characteristics of the basketball rim system 12. Consequently when it is stated that the apparatus 10 is intended to determine the energy absorption or rebound characteristics of the basketball rim, such test is not limited to the basketball rim 13 itself but is referring to the basketball rim system 12 and how the system 12 reacts to a basketball striking the rim 13.

The basketball rim 13 is connected to the backboard 14 through a basketball rim bracket 16 (FIG. 1). The basketball rim 12 includes a net 18 that depends downward and generally somewhat inward from the rim 13. The basketball rim 13 has an outer rim section 20 which is cantilevered from the backboard 14. The rim 13 typically includes a wire or rod 21 (FIG. 4) secured to the bottom rim surface to facilitate mounting of the net 18.

The basketball rim rebound testing apparatus 10 includes a force application means 22 for applying a downward vertical force on the outer rim section 20 to cause the outer rim section 20 to deflect in response to the magnitude of the impact of the force. The apparatus or device 10 includes a signal generating and processing means 26 for producing and receiving an electrical signal, containing information relating to deflection of the rim system, and for analyzing such information to determine rebound or energy absorption characteristics. In the preferred embodiments illustrated, the device 10 analyzes and determines a rebound velocity characteristic that is related to the elasticity or energy absorption characteristics of the basketball rim system 12.

The force application means 22 in preferred forms is comprised of an impact means 23 for applying a downward force to simulate the impact of a falling basketball striking the rim 13. The preferred impact means 23 includes a slide weight 60 mounted to a portable depending guide frame means generally designated with the numeral 28 for guiding the weight 60 in a prescribed path. The weight 60 and guide means 28 are connected to the basketball rim 13 by a mounting means 35 (FIGS. 1, 4) so that force applied by the weight is transmitted to the rim 13.

The depending guide frame 28 includes an upper section 30 and a lower section 32. The upper section 30 includes the mounting means 35 for releasably attaching the apparatus 10 to the basketball rim.

The mounting means 35 preferably includes a "C" shaped hook 36 having a "C" shaped opening 37 for receiving the edge of the basketball rim 13. The upper section 30 is formed of a rod 38 that has a threaded section 40 (FIG. 2) that screws upward into the opening 37.

A saddle clamp member 41 fits within a socket in the top of threaded section 40. The saddle is shaped to receive the bottom section of the rim 13 and the wire or rod 21 affixed thereto. A free pivot mount enables the rod 38 to rotate while the saddle clamp member 41 remains rotatably stationary on the rim and wire or rod 21. The rod 38 can thus be rotated to firmly clamp the basketball rim 13 in the opening 37. The rod 38 also has a lower headed end 42 (FIG. 4) that is freely rotatable within a block 44.

The lower section 32 includes a guide rod 52 having an upper headed top end 53 also freely rotatable in the block 44. The guide rod 52 preferably has a length exceeding one meter.

Rods 52 and 38 are coaxial and, by provision of their headed ends mounted in block 44, will freely rotate coaxially independently of one another. A knurled knob 43 is provided on rod 38 to facilitate rotation of rod 38 and securing of the attachment means to the rim 13.

In one preferred embodiment, the slide weight 60 weighs approximately 22 ounces, equal to the weight of a basketball. The slide weight 60 is preferably substantially cylindrical in its outer cross sectional configuration. The weight 60 has a central longitudinal bore with bushings at opposed ends. In a preferred from, the bushings are formed of low friction plastic bearing material. The bushings facilitate low friction sliding motion (essentially free fall) of the weight along the lower guide rod section 52.

In use, the weight 60 may be lifted to the block 44 which functions as a stop to standardize the drop height of the slide weight 60 from a resilient means 55 preferably located at the bottom of the guide rod 52. It has been found that the weight dropping approximately one meter simulates a basketball thrown from approximately 20 feet from the basketball rim and impacting the outer rim section 20.

Alternatively the resilient means may be mounted to the bottom of the weight 60. A grip 61 may be provided at the top surface of the weight as a hand hold or gripping surface useful when retrieving the weight from within the sleeve housing 59. The grip 61 also serves as an abutment surface to contact the bottom surface of the block 44 to consistently gauge the drop height of the slide weight 60.

The slide weight 60 is received by resilient means 55 (FIGS. 3, 5) situated along the prescribed path of the weight for abutment with the downwardly sliding weight. The resilient means 55 is utilized to initially absorb the kinetic energy of the weight 60 as stored energy to bring the weight to a stop and then to transfer the stored energy back to the weight to effect a rebound of the weight back along the prescribed path. A measurable portion of the impact or kinetic energy of the moving weight 60 is absorbed by the basketball rim system 12.

The resilient means 55 is preferably a calibrated compression spring 56. With the calibrated spring 56, and a fixed drop height for the slide weight 60, consistent results may be observed by dropping the weight against the spring and measuring the velocity of the weight as it rebounds. Such velocity is related to the elasticity or energy absorption characteristics of the basketball rim system which absorbs a portion of the impact.

The calibrated compression spring 56 is selected to rebound the weight to approximately 75% of its drop height when the spring rests upon a hard stationary surface. Of course the rebound height will be directed affected by the energy absorption of the basketball rim system. A "live" system will result in maximum weight rebound (approaching 75% as an absolute maximum) while a "dead" system will result in a lesser rebound height since the rim system will have absorbed more energy.

The calibrated spring 56 includes a cap 57 (FIG. 5) on a top end thereof. The cap 57 includes a flat top surface for flush abutment with the slide weight 60. The bottom end of the compression spring 56 rests against an abutment surface 58 at the bottom end of the guide rod 52.

The spring coaxially receives the rod section 52 which is rigidly attached to the abutment surface 58 by means of threads. Other secure attachment means may be provided. However, threads are preferred to facilitate removal and replacement of the spring 56.

To maintain rebound consistency, it is preferred that the base or bottom end of the spring be firmly secured to the abutment surface 58 by appropriate attachment devices such as screws 51 or other appropriate mechanical clamping devices.

Figure 6:
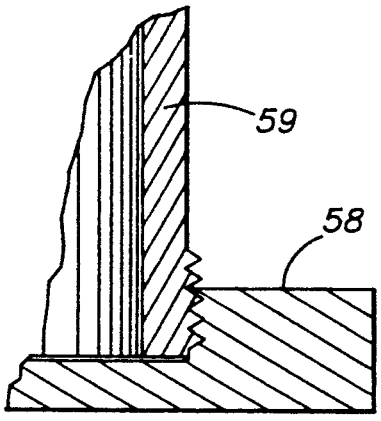
FIG. 6 is an enlarged detail of an area marked by a dashed circle 6 in FIG. 5.

The resilient means 55 is partially encased within an upright sleeve 59. The sleeve 59 is threadably engaged (FIG. 6) on the abutment surface 58. The axis of the sleeve 59 is, in a preferred form, slightly offset from the axis of the lower rod section 32. This facilitates an adjustment feature for a photocell 66 to be described in greater detail below. It is sufficient to note that rotation of the sleeve 59 about its axis will bring any point on the sleeve progressively closer to or further from a corresponding point on the surface of the slide weight.

The signal generating and processing means 26 includes a velocity measuring transducer preferably in the form of a sensor 65 mounted in the first preferred form to the sleeve 59 for detecting movement of the slide weight 60 along the path defined by the lower guide rod 52. The sensor 65 (FIG. 3, and as shown in schematic form in FIG. 10) preferably includes a photocell 66 mounted in a sensor box 67 to the sleeve 59. The photocell 66 is preferably a high resolution optical reflective sensor with combined emitter and detector capabilities. The "HBCS-1100" photocell produced by Hewlett-Packard is preferred. The photocell 66 has a bifurcated aspheric lens used to image active areas to a spot approximately 4.27 millimeters in front of the package.

To facilitate selective adjustment of the slide weight 60 in relation to the photosensor 66, an adjustment provision between the slide weight and sleeve 59 is provided (FIG. 5). Such adjustment is enabled through the offset axes between the sleeve 59 and lower rod 58. Selective rotation of the sleeve will move the photocell 66 closer to or further away from the slide weight. Thus, the sleeve may be selectively adjusted to bring the photocell within the 4.27 millimeter focus distance set forth above.

Light emitted from the photocell 66 is selectively reflected and received by the detector portion of the photocell as it is reflected from indicia 70 (FIGS. 3, 5, 9) provided along the length of the slide weight 60. High reflective indicia 70 is spaced along the length of the weight 60 to reflect light impulses that may be utilized to calculate the velocity of the slide weight as it drops and subsequently rebounds.

Figure 9:
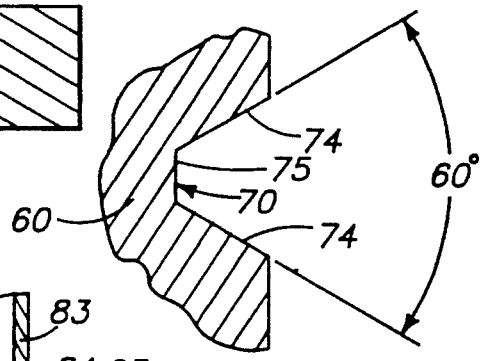
FIG. 9 is an enlarged detail view of a reflective surface on the slide weight of the present device.

The preferred form of indicia 70 includes first and second grooves 71, 72 formed in the weight. The grooves 71 and 72 are annular and consistent about the slide weight 60. Each includes a machined axial reflective surface 75, one example of which is shown in detail by FIG. 9. The reflective surfaces 75 are situated between diverging groove walls 74 set at approximately 60° from one another as indicated in FIG. 9. The reflective surfaces 75 include axial dimensions of approximately 0.2032 millimeters, with a tolerance of approximately ±0.05 millimeters. The preferred depth of the grooves is approximately 2.54 millimeters, with a tolerance of ±0.254 millimeters.

The grooves are spaced apart axially along the length of the weight 60 by a preset distance, preferably a distance of approximately 10 centimeters. This distance is established arbitrarily to provide a constant in the calculations for determining the velocity of the weight as it passes by the photocell 66.

The photocell 66, indicia 70, and remaining operational circuitry 26 described below function as a velocity measuring transducer for measuring elapsed time during rebound of the slide weight over the prescribed distance between grooves 71 and 72 along the path defined by the lower guide rod 58.

Figure 8:
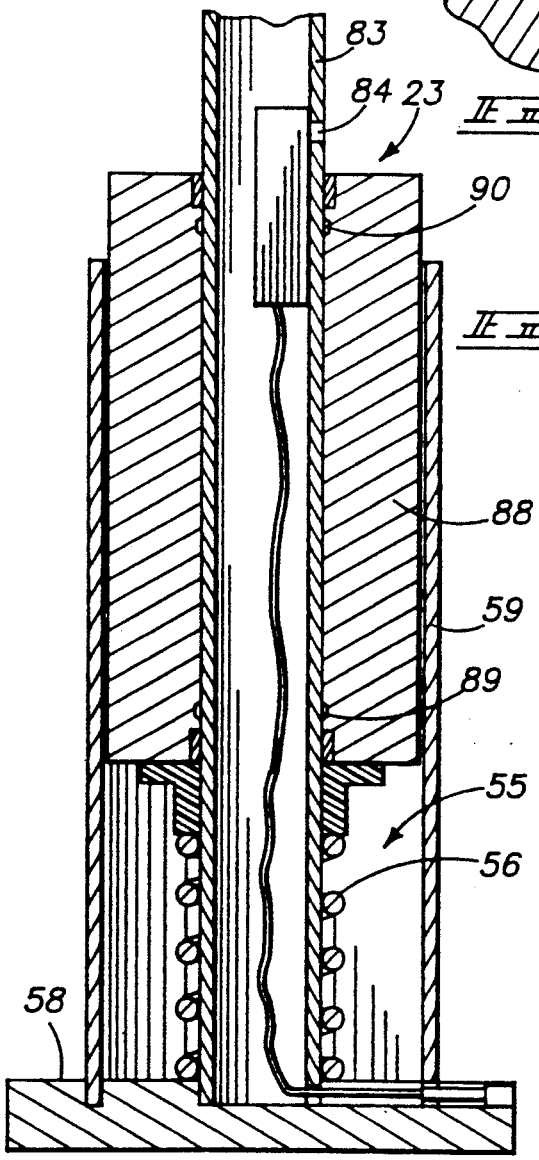
FIG. 8 is an enlarged sectional view taken along line 8—8 in FIG. 7.
Figure 7:
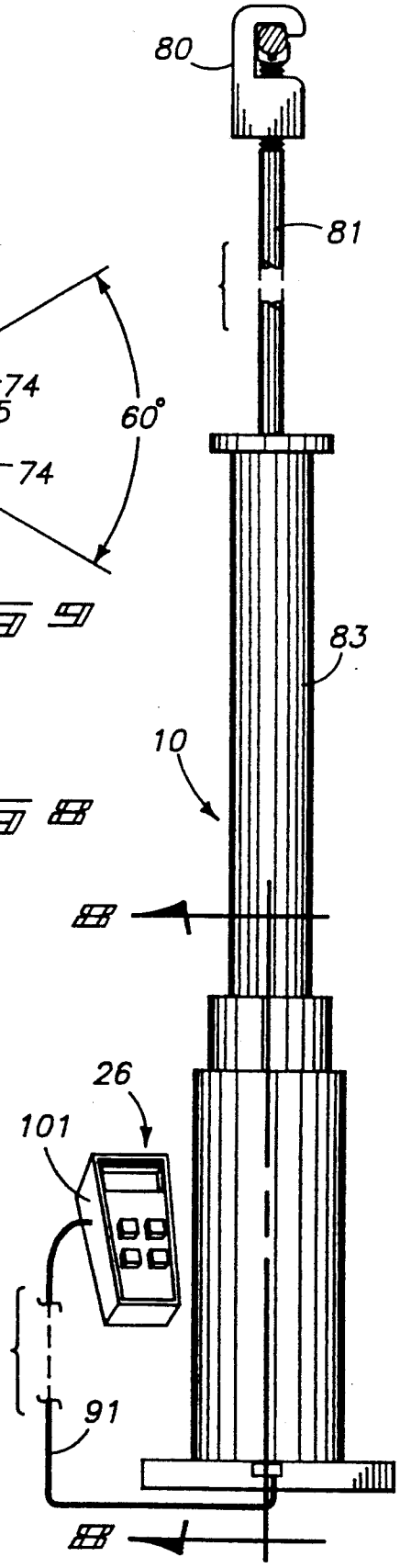
FIG. 7 is an elevational view of a second preferred form of the present device.

FIGS. 7 and 8 illustrate a second preferred form of the apparatus in which a hook 80 is provided atop a first upper section 81 that is substantially identical to the hook and upper sections 36 and 30 described above. The second preferred form, however, includes a lower section 83 that is tubular in construction to mount a photocell 84 within its confines. The photocell 84 is substantially identical to the photocell 66 discussed above. It detects the passage of internal first and second annular grooves 89, 90 provided within a slide weight 88. In this configuration, the photocell 84 is protected within the hollow lower section 83. Its operation, however, remains substantially identical to the operation of the first preferred form as described below.

Figure 10:
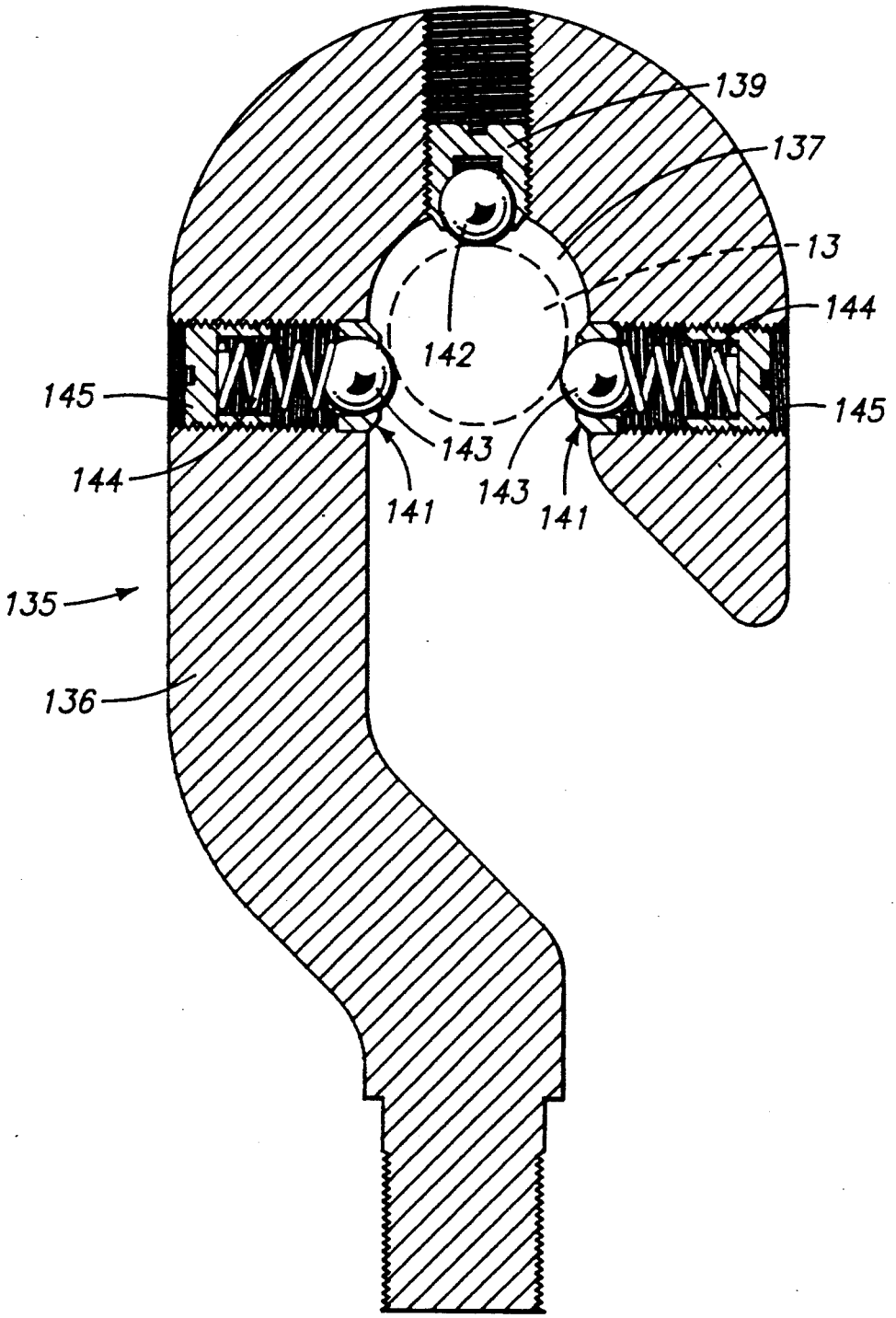
FIG. 10 is a schematic of a computing system in accordance with one embodiment of the present invention.

Described forms of the present invention may function through the circuitry shown in FIG. 10. The circuitry is divided into spaced portions connected by an electrical cable 91. Portions of the circuitry are provided within the sensor box 67 adjacent to the photocell 66. The remainder of the circuitry may be provided within a hand held computing case 101, or may be attached to the unit.

In the computing and display circuitry, the photocell 66, 84 is used as a reverse bias photodiode. A transistor, found within the sensor box 67, is not used but is connected simply to reduce current leaks. The photocurrent is approximately 0.3 microamps when the reflecting surfaces of the grooves 71, 72 or the grooves 89, 90 of the second embodiment are in appropriate focus.

Referring to the sensor box section 67 of the circuitry shown in FIG. 10, several high speed operational amplifiers (OA) are shown.

A first operational amplifier OA1 is a current-to-voltage converter. Voltage from this amplifier is equal to the product of 270 k ohms and the current input from the photocell 66. Voltage from the operational amplifier OA1 is amplified by voltage amplifier OA2 with a nominal voltage gain of about 58. A 4.7 k resistor is connected between ground and OA2 to facilitate change for different gains. This stage is DC coupled to provide the focus signal. Voltage gain is $1+27\ k/(r)$ where r is the value of the 4.7 k resistor.

Operational amplifier OA3 is an AC coupled stage intended primarily to drive signals through the length of cable 91 between the sensor box 67 and the interface within the hand held unit 101. OA3 incidently provides a voltage gain of approximately 2.0. It also provides the first high pass filter in the signal chain.

Operational amplifier OA4 is included simply to provide a voltage proportional to photocurrent that may be read by a simple meter (not shown) to assist in focusing the sensor as discussed above. Thus, through provision of OA4, voltage may be detected to determine proper focus of the photocell, by holding one of the surfaces 75 in alignment with the beam and rotating the sleeve until the prescribed voltage is indicated on the meter. The lead from amplifier OA4 connects to a test point and may be provided in the hand held unit, or on the sensor box 67 to facilitate the above "focusing" the photocell. Operational amplifier OA3 is connected in series to operational amplifier OA5. OA5 is included within the instrument or interface box as a receiver with low pass filtering at the connector cable 91 end. It is utilized to "clean up" the signal received from OA3 before it is passed to a differentiator OA6.

The differentiator operational amplifier OA6 includes a 0.001 microfarad input capacitor provided to determine the midpoint of pulses received from the photosensor.

Amplifier OA7 is a comparator with a Schmidt trigger latching function. When the input signal becomes more negative than a threshold set by the bias network and a positive feedback resistor, the output goes positive. This turns on the "signal" transistor 102. At the same time the threshold is changed (by current and feedback resistor) to a more positive voltage. This intentional hysteresis minimizes noise on the signal output.

The "signal" output transistor 102 is simply a switch to interface the positive and negative 12 volt analog circuits to zero to +5 volt computer logic.

It is pointed out that the amplifiers OA3 and OA5 are included primarily to minimize effects of a long cable 91 between the sensor box 67 and the instrument case 101. It is quite possible that the instrument could be mounted directly to the sleeve housing 59 or elsewhere on the device and would not require lengthy cable connections. In such a case, OA3 and OA5 may not be necessary. Similarly, amplifier OA4 is used only to provide DC coupled "focus" reference voltage and is therefore not strictly required for operation of the present invention.

Impulses received through the circuitry described above are fed to computer logic. Such may be provided within the hand held case 101 through provision of appropriate microprocessor based instrument powered by dry cell batteries. An "Intel" 51 Series processor produced by Intel, Inc. may be used with software imbedded in an EPROM. The processor's scratch pad RAM will be used for stack operations and real time variables without additional memory required. The timing circuit may consist of appropriate components needed to buffer the external signal into two processor timer inputs. The microprocessor controls a readout in the form of a 4 to 6 digit alphanumeric LED display interfaced to the processor's bus. Input devices including on/off and other controls will consist of simple push button switches.

The computer and interface are programmed to perform the following minimal functions:

1. Measure the time interval between passage of the two marks at the photosensor on the downward pass.
2. Measure the time interval between passage of the marks in the upward direction.
3. Compute the ratio of the times, which is the inverse of the ratio of the velocities.
4. Square the velocity ratio to arrive at the energy ratio, or fraction of impact energy returned to the weight. (One minus this value is the energy absorbed by the goal.)

For operation, the device is first connected to a basketball rim at the point 20 furthest from the support. This is typically termed the "six o'clock position" as that point on the rim exhibits the most deflection upon being struck by a basketball. The upper section 30 of the guide frame is then rotated to bring the releasible attaching means into firm contact with the basketball hoop. In so doing, the saddle 41 is moved upwardly to engage and clamp the rim and the lower rod or wire 21, thereby securing the unit in a vertical, suspended orientation from the rim. The device may be plumbed using an existing form of level device. However, if the unit is suspended freely initially from the six o'clock position on the rim, it will tend to plumb itself and remain in that position if care is taken during securement of the clamp.

Operation to test energy absorption characteristics of the rim may commence by turning on the sensing circuitry and lifting the slide weight 60 upwardly until the top surface of the grip 61 touches the bottom surface of the block 44. The weight can then be dropped. The descending weight slides along and is guided by the guide rod 52 toward the resilient means 55. Before striking the spring 56, the reflective grooves 71, 72 pass the photocell 66 which registers impulses due to reflectance of beams from the reflective indicia surfaces 75. The elapsed time between the optical signals between the grooves can be used, if desired, to calculate an initial velocity of the slide weight 60, though it is also feasible to simply make use of the elapsed times as suggested above. The initial velocity figure may be calculated through the computer circuitry. Next, the weight strikes the top surface of the compression spring. The impact causes the spring to compress and apply tension to the guide frame and, in turn, the basketball rim system 12 to deflect the rim. The rim absorbs part of the energy of the impact. The rebound time or velocity is thus related to the rebound energy absorption characteristics of the rim system.

The contracted spring will expand, causing the weight to be projected back upwardly along the path defined by the lower rod section 32, again past the photocell. A rebound velocity measurement is taken between impulses produced through the photocell as the reflected surfaces pass by. The second rebound velocity reading is then calculated. These velocities are compared within the logic of the circuitry and a resulting figure is arrived at using known formulae which reflects the energy absorption of the rim system 12. This result is displayed on the digital readout as a percentage of energy absorption by the rim system.

Extensive field testing using the above apparatus connected to a personal computer utilizing a "CTM-05" clock counter produced by "Metrabyte" of Taunton, Mass. and an IBM personal computer (in place of the hand held unit 101) were utilized to test 48 different basketball rim systems. Initial times ($t_i$) reflecting the time passing between sensing the first and second grooves on the initial downward movement of the weight, averaged 0.2865 seconds with a standard deviation of 0.00007 seconds. Consequently the calculation of the initial velocity may be used only for calibration. During normal testing the initial velocity may be assumed to be constant from one test to another. Thus, for many tests, only the rebound velocity calculation is necessary.

Final times ($t_f$) related to the time between impulses received on the first weight rebounds averaged 0.03452 seconds for all rims tested, with a standard deviation value at 0.00253 seconds. Averaged initial velocities were calculated at 3.82 meters per second with a standard deviation of 0.01 meters per second. Final velocities ($V_f$) of the rebounding weight averaged 2.96 meters per second with a standard deviation of 0.20 meters per second. The maximum final velocity measured was 3.27 meters per second and the minimum final velocity was 2.26 meters per second, thus exhibiting a range of 1.01 meters per second. Calculated energy absorption percentage values of the total energy developed averaged 39.58% with a standard deviation of 7.68%. The maximum rim system energy absorption percentage recorded was 64.95% and the minimum value was 26.03%, thereby indicating a substantial difference between energy absorption rates of different basketball rim systems. The range differential was 38.92%.

Standard rims tested (non-movable rings) with energy absorption values ranging from 33.84% to 42.02% with the average being at 39.09%. All rims tested averaged 39.58% absorption. This figure, representing an overall average value, is useful as a target percentage rate for compliance by rims tested using the present system.

To maintain accuracy in the device, calibration of the spring 56 may be easily accommodated, knowing the desirable approximate 75% restitution coefficient. Given this data, the circuitry may be simply designed to place the device in a test mode by which the velocities ($v_i$ and $v_f$) would be compared to determine whether the weight, at a free fall, would rebound 75% of its drop height with the unit mounted on a stationary support surface such as a concrete floor.

The force application means 22 in the further preferred form shown in FIGS. 11–18, includes another preferred form of the impact means 23 for applying a downward force to simulate the impact of a falling basketball striking the rim 13. This preferred impact means 23 includes a slide weight 160 is mounted to the portable depending guide frame means 28 for guiding a weight 160 in a prescribed path. The weight 160 and guide means 28 are connected to the basketball rim 13 by a mounting means 135 (FIGS. 11, 14) so that force applied by the weight is transmitted to the rim 13.

The mounting means 135 preferably includes a hook 136 having an opening 137 for receiving the edge of the basketball rim 13. Securing means 140, including opposed detent clamp members 141, and a top rim engaging ball 142 are angularly spaced about the opening 137 to receive and releasably secure the device to a standard basketball rim as shown in FIG. 14.

The top ball 142 of the three is adjustably set in position by a set screw 139 to engage in tangential contact with the top surface of the rim wire. The ball 142 allows the device to hang plumb from the rim, thereby assuring consistency and accuracy of measurements using the sliding weight.

The detent clamp members 141 include spring biased balls 143 at opposed positions on the hook below the top ball 142. The detent balls 143 are set by compression springs 144 to snap over and engage opposed sides of the basketball rim. The inwardly biased balls center the top ball 142 in position engaging the top surface of the rim and securely hold the device against elevational movement on the rim, while allowing the device to hang plumb from the rim. The springs 144 may be adjusted by set screws 145 to vary the amount of force required to attach and release the hook from a basketball rim. The clamp members thus serve the dual function of centering the top ball 142 on the rim and securely yet releasably holding the device in relation to the rim.

It should be understood that the above described hook member is exemplary of the mounting means 135, and may be interchanged or substituted for the mounting means described for other embodiments of the invention disclosed herein.

Figure 11:
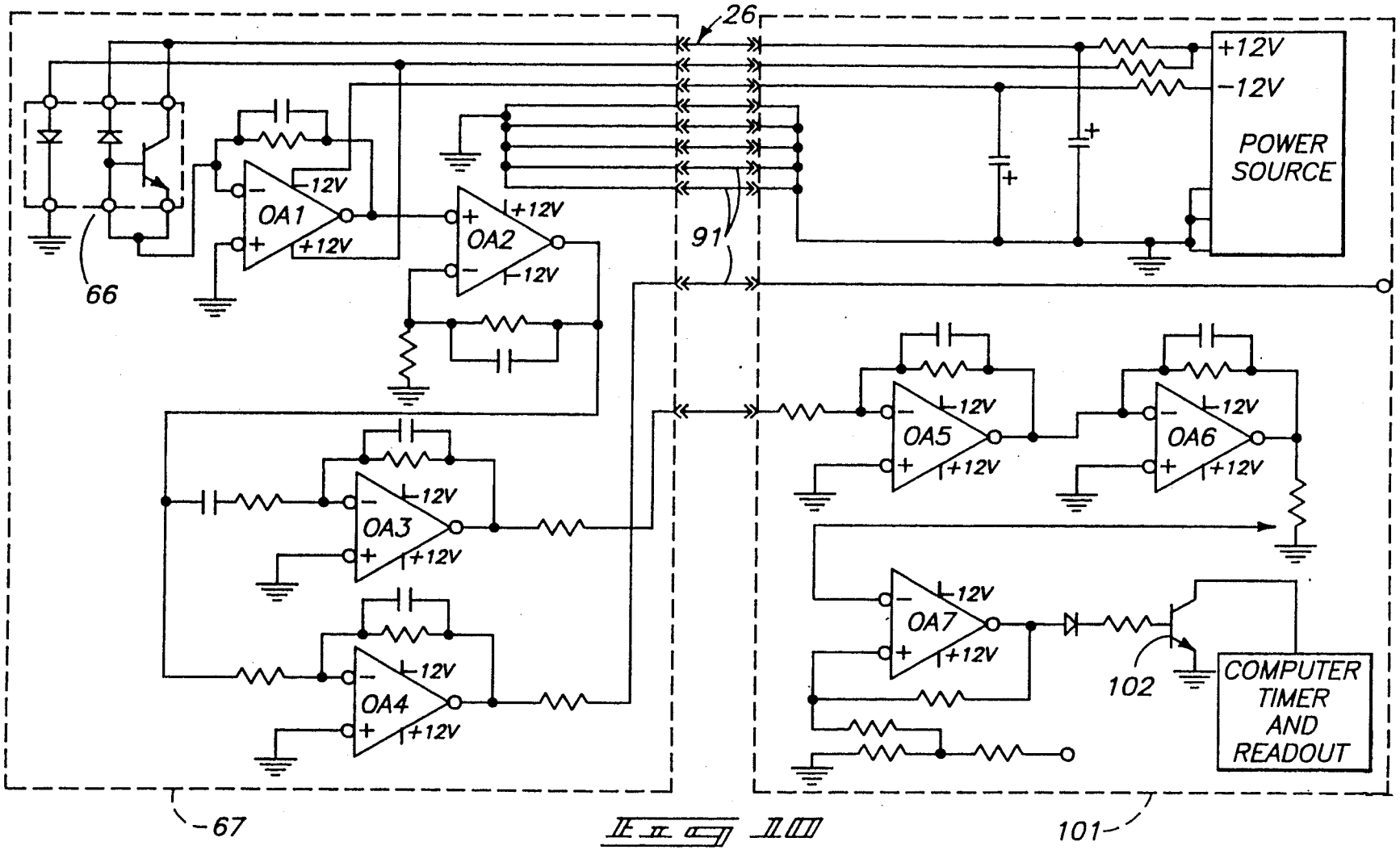
FIG. 11 is a fragmented elevation view of a further preferred form of the present device.
Figure 11:
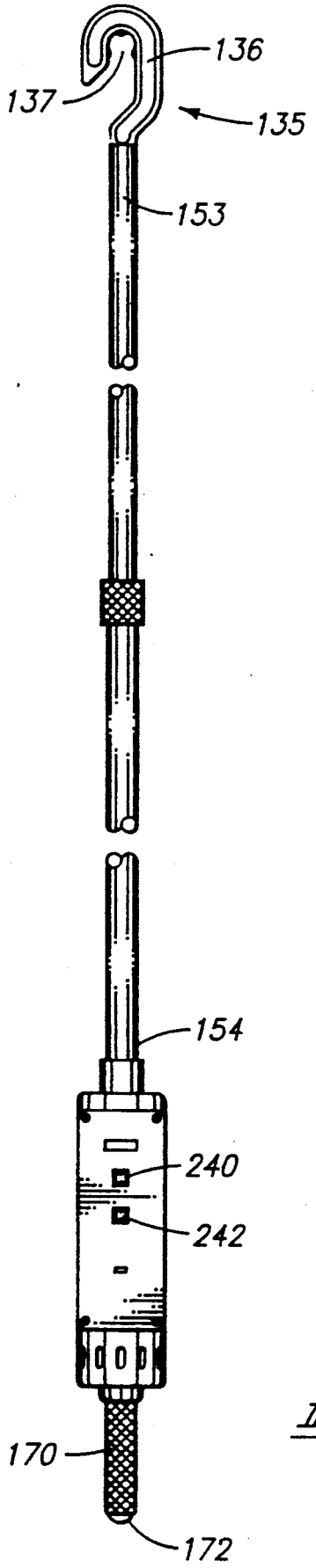
Figure 13:
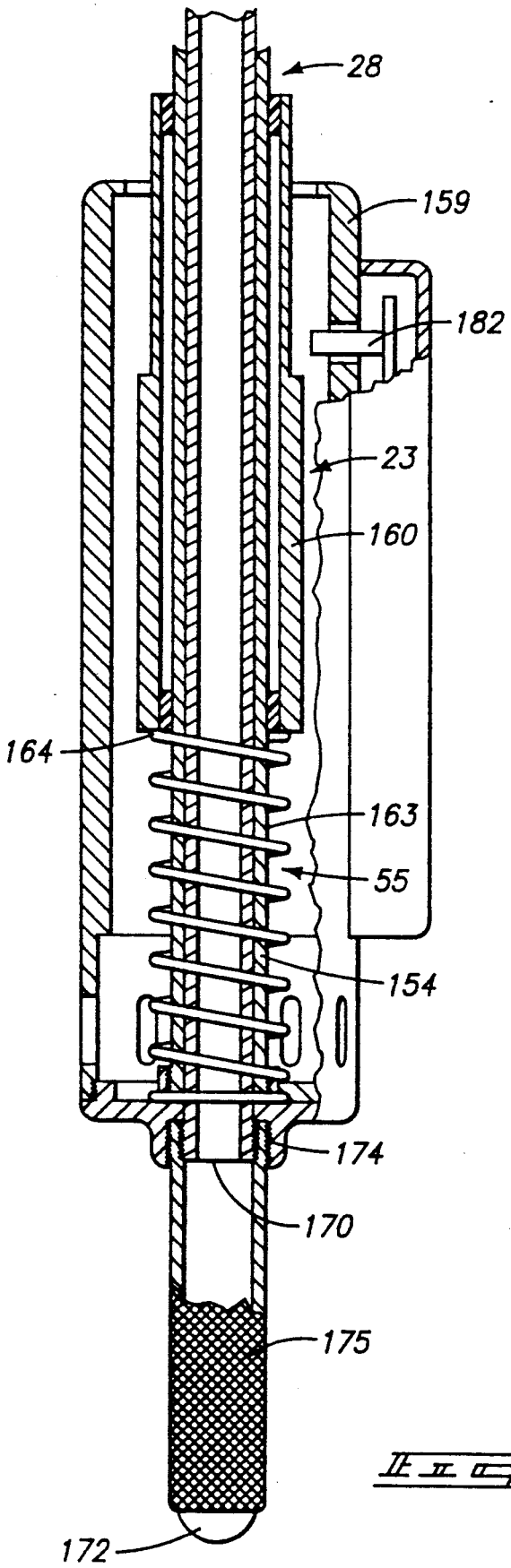
FIG. 13 is an enlarged sectional fragmented view taken substantially along line 13—13 in FIG. 12.

The guide means 28, in the further preferred form includes a tubular guide rod 152 FIGS. 11, 13 having an upper end 153 secured to the hook 136 and a bottom end 154 secured to a weight receiving housing 159. The guide rod 152 may be supplied in sections, joined together at a stop collar 161, preferably by appropriate standard screw threads.

Cylindrical slide weight 160 is mounted to the guide rod 152 by bearings which may be similar to those shown in FIGS. 5 and 8. Weight 160 may be lifted to the stop collar 161 on the rod 152. The stop collar is set a prescribed distance from the housing 159 to determine a prescribed consistent drop height for the weight.

Within the housing is a compression spring 163 (FIG. 13) having a top end 164 for engagement with the slide weight 160. Spring 163 functions as the resilient means 55 described above and in fact may be similar or identical to the spring 56 and cap 57 already described. The bottom end of the spring rests against the housing 159 within an internal bore formed therein.

A second rod 170 is threadably attached to the housing at its bottom end. Rod 170 extends coaxially with the guide rod 152 from the housing to a bottom end 171. A ball end 172 is mounted to the rod bottom end. Ball end 172 is provided for tangential engagement with hard surfaces such as concrete floors for calibration purposes.

Rod 170 is slidably mounted within the rod 152 and releasably secured to the housing 159 by screw threads 174 at the end of a handle portion 175. When the hook 136 is secured over a rim, the handle 175 may be turned to unthread and disconnect the rod 170 from the housing to be extended downwardly to engage the adjacent floor surface. Rod 170 is indexed along its length at 173 (FIG. 12) to indicate rim height when the device is appropriately secured to a rim. Rim height may be read by alignment of the calibration indicia 173 on the rod with the bottom edge of the housing 159. The threads 174 securely mount the rod 170 to the device during testing.

Figure 15:
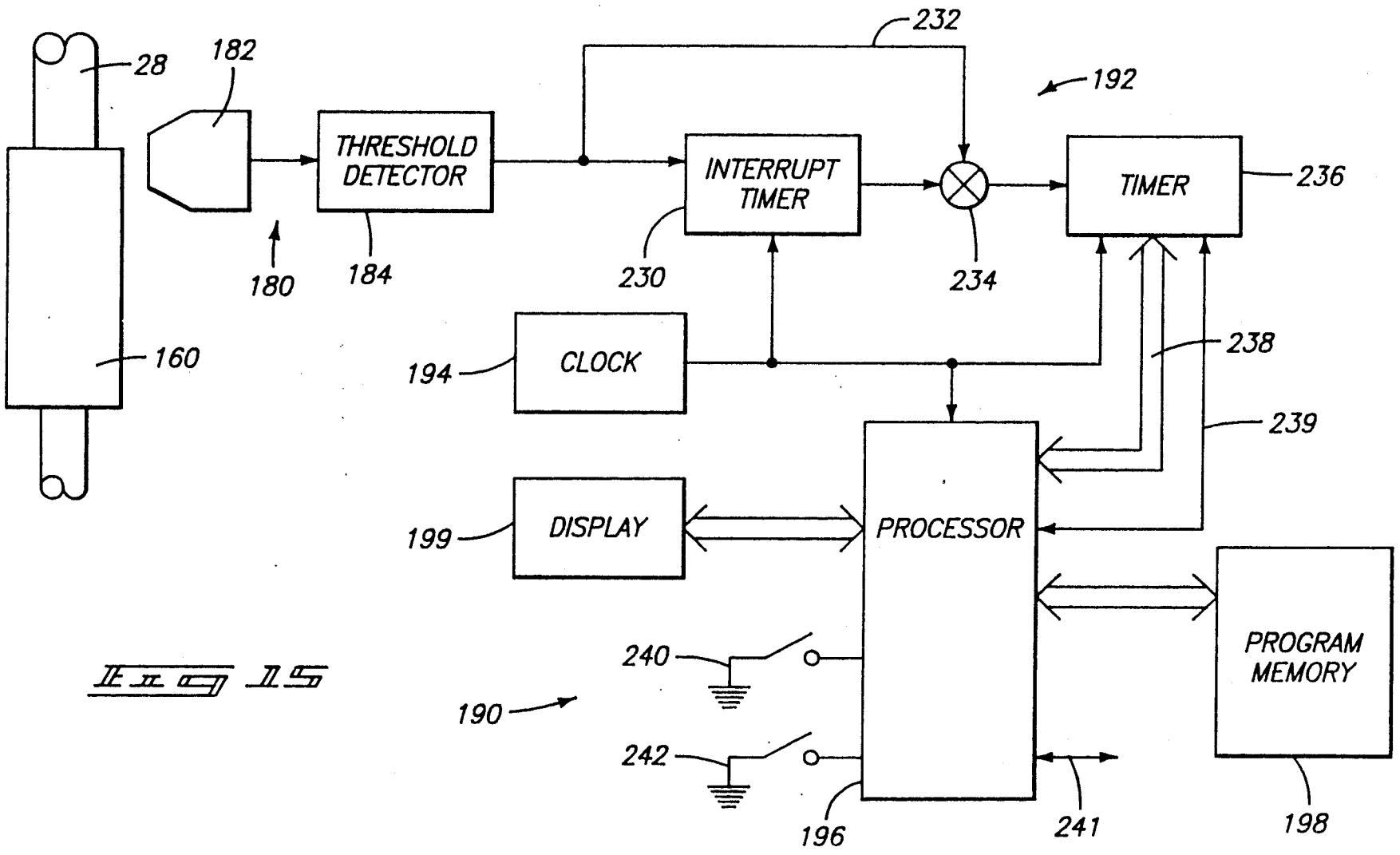
FIG. 15 is a block diagram of a motion sensor and computing system in accordance with the further preferred embodiment of the present invention.
Figure 11:
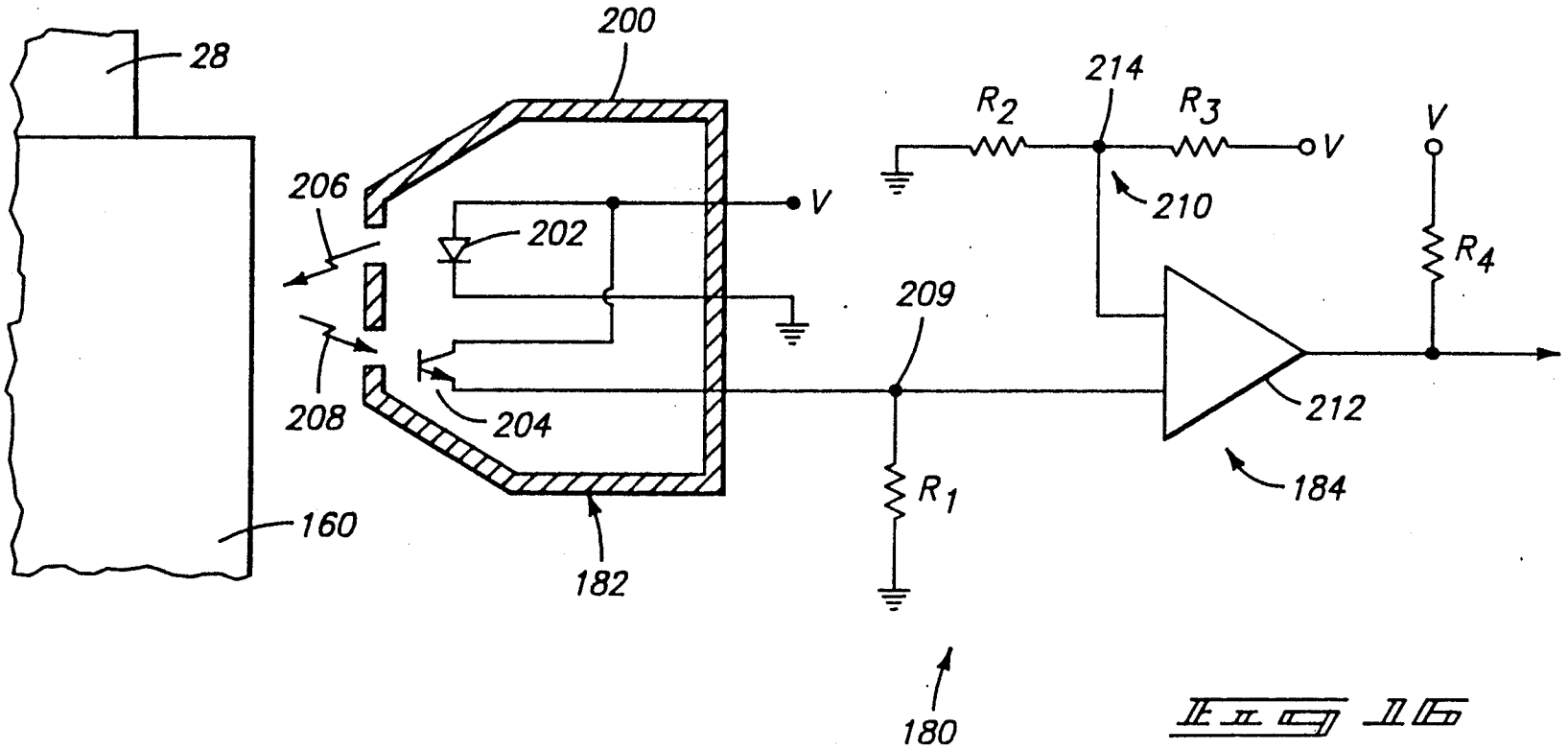

FIG. 15 shows a block diagram of a motion sensor 180 and a computing system 190 in accordance with the further preferred embodiment of the present invention. The motion sensor 180 detects the presence and absence of the slide weight 160 at a preselected position on the prescribed path defined by guide means 28 as the slide weight falls and rebounds along the prescribed path. The computing system 190 measures successive time durations that the motion sensor 180 detects the presence of the slide weight 160 and then calculates a value related to the elasticity or energy absorbing characteristics of the basketball rim system in accordance with the measured time durations.

The motion sensor 180 includes a photosensor 182 and a threshold detector 184. The photosensor 182 is positioned within the housing 159 adjacent a preselected position on the guide means 28 above the compression spring 163. The photosensor 182 is spaced from guide means 28 a sufficient distance to permit the passage of the slide weight 160 therebetween, as shown diagrammatically in FIG. 15. The photosensor 182 is preferably an infrared photocell which emits and detects infrared light. An advantage of the photosensor 182 is that it does not require focusing or adjustment before each measurement.

FIG. 16 shows the motion sensor 180 in more detail. Photosensor 182 comprises a casing 200, a light emitting diode 202, and a photoelectric cell 204. A voltage V is applied across the diode 202 causing the diode to emit light 206. Light 206 reflects or bounces off of the slide weight 160 (when present) or the guide means 28 (when the slide weight is not present) in the form of reflected light 208. The reflected light 208 is captured by the photoelectric cell 204 which outputs electrical variations in response to changes in light intensity.

Preferably, the photosensor 182 generates a relatively large voltage across resistor $R_1$ (at node 209) when the slide weight 160 is present. The short distance between the photosensor and the side surface of the slide weight results in a high intensity of the reflected light 208. This causes photocell 204 to be more conductive (or less "resistive") so that node 209 has a potential near voltage V. In contrast, the photosensor 182 generates a relatively low voltage at node 209 when the slide weight 160 is absent. The light intensity of the reflected light is low and photocell 204 is more "resistive" resulting in a voltage at node 209 which is substantially less than voltage V.

The threshold detector 184 compares the voltage generated by photosensor 182 to a threshold voltage level. The threshold detector 184 comprises a voltage divider 210 and a comparator 212. The voltage divider 210 comprises two serially connected resistor $R_2$ and $R_3$ coupled between a voltage V and ground. The divider 210 provides a reference threshold voltage at node 214. The threshold voltage is then compared to the voltage output by the photosensor 182 in the comparator 212.

When the slide weight 160 is beside the photosensor 182, the photosensor voltage exceeds the threshold voltage. As a result, the threshold detector 184 outputs a first signal indicating that the slide weight is present. On the other hand, when the slide weight 160 is not beside the photosensor 182, the photosensor voltage does not exceed the threshold voltage. The threshold detector therefore outputs a second signal indicating the absence of the slide weight. In the preferred embodiment, the first and second signals are in the form of two different analog voltage levels. However, the threshold detector 184 may include an A/D converter so that digital signals can be output to the computing system 190.

Figure 17:
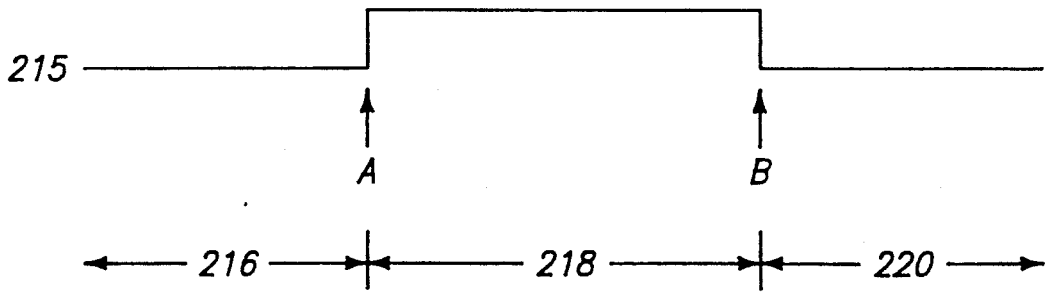
FIGS. 17 and 18 are diagrammatical illustrations of waveforms used to describe the operation of the motion sensor and computing system shown in FIG. 15.

FIG. 17 is a diagrammatical illustration of waveform 215 showing the detection of the slide weight 160. More particularly, the waveform 215 shows the presence and absence of the slide weight 160 in front of the photosensor 182. During times 216 and 220, the slide weight is not in front of the photosensor 182 (i.e., it is absent). During time 218, the slide weight is in front of the photosensor 182 (i.e., it is present). The detections of the leading and trailing edges of the slide weight 160 are made at times A and B, respectively. Accordingly, the motion sensor 180 outputs a first signal during time 218 between the detection of leading edge (at time A) and trailing edge (at time B) during time period 218 and a second signal during times 216 and 220.

As shown in FIG. 15, the first and second signals from the threshold detector 184 are input to the computing system 190. Computing system 190 comprises timing circuitry 192, a system clock 194, a processor 196, a program memory 198, and a display 199.

The timing circuitry 192 measures time durations that the motion sensor 180 detects the presence of the slide weight 160. With respect to the illustration in FIG. 17, the timing circuitry 192 measures the time duration 218 between the detection of the leading edge of the slide weight (at time A) and the trailing edge of the slide weight (at time B). The timing circuitry 192 comprises an interrupt timer 230, a gate 232, a summer 234, and a timer 236. The signals from the motion sensor 180 are input to the interrupt timer 230. When the motion sensor initially detects the slide weight 160 (at time A), the interrupt timer 230 initiates the timer 236. When the motion sensor no longer detects the slide weight 160 (at time B), the gate 232 stops timer 236. The gate 232 bypasses interrupt timer 230 to stop timer 236 more quickly and thereby facilitates accuracy of the timing measurement. The time duration measured by the timer 236 is output to processor 196 over bus lines 238.

Figure 18:
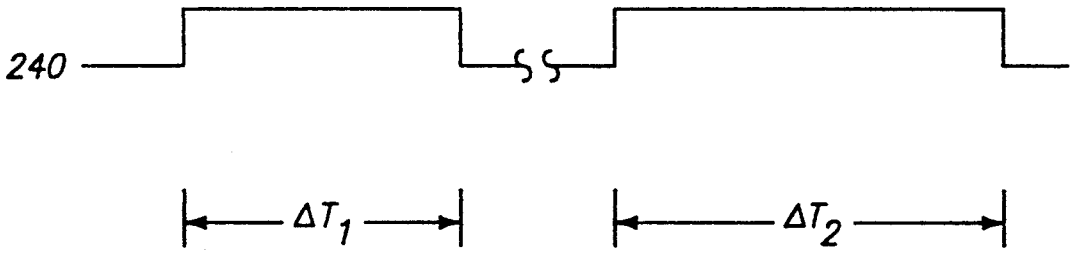

The timing circuitry 192 preferably makes two measurement per test drop: a first measurement is made while the weight is falling and a second measurement is made while the weight is rebounding. FIG. 18 is a diagrammatical illustration of a waveform 240 showing the timing durations that the motion sensor detected the falling and rebounding weight. When the weight is falling, the timing circuitry 192 measures a time duration of $\Delta t_1$. When the weight is rebounding, the timing circuitry 192 measures a longer time duration of $\Delta t_2$. The rebounding time duration is longer than the falling time duration because the weight is moving more slowly. The slower movement results partially because the rebounding weight moves vertically upward against the force of gravity and partially because some of its energy has been absorbed by the basketball rim system. The timing circuitry 196 outputs a signal over conductor 239 to inform the processor 196 when two successive time measurements have been completed.

The processor 196 employs the two successive time measurements provided by the timing circuitry 192 to compute an energy absorption value of the basketball rim system. Preferably, the processor 196 uses the following equation to compute a value relating to the energy absorption of the basketball rim system:

$$1-(\Delta t_1/\Delta t_2)^2$$

wherein $\Delta t_1$ is the time duration measured while the slide weight is falling and $\Delta t_2$ is the time duration measured on the rebound of the slide weight.

The processor 196 can output the results of the test to the display 199 or over a serial port 241 to a personal computer or the like. The processor 196 can also store the results in RAM memory internal thereto to cumulate data of numerous tests. In this manner, data may be averaged over several tests. The clock 194 synchronizes the operation of computing system 190. The clock 194 includes an oscillator and provides timing pulses preferably in the megahertz range to interrupt timer 230, timer 236 and processor 196.

Figure 12:
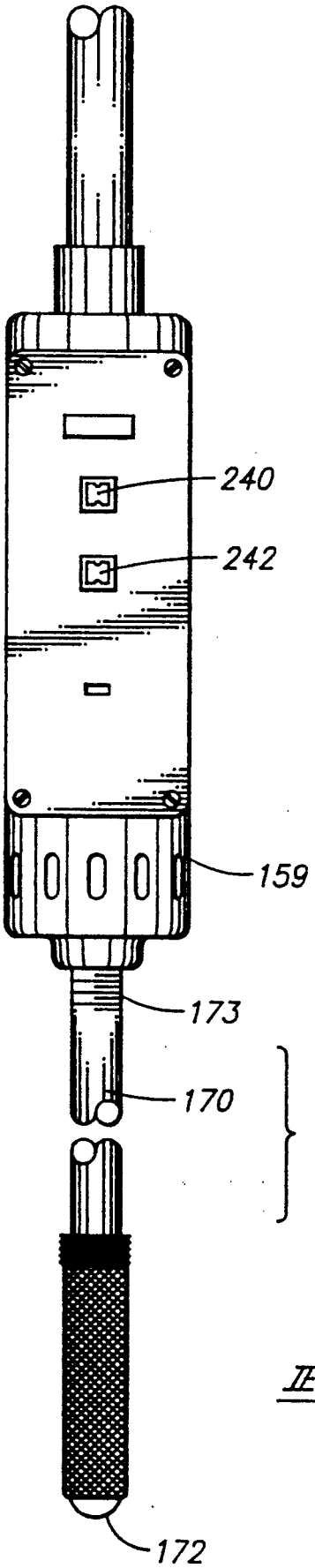
FIG. 12 is an enlarged detail view of the further preferred form shown in FIG. 11.

The processor 196 is coupled to two input switches or buttons 240 and 242 which are mounted in housing 159 (FIGS. 11 and 12). The initialize button 242 arms the computing system 190 in preparation of the next measurement. Mode button 240 selects the appropriate mode of the processor 196 which preferably has four modes: calibration, test, data, and auto modes. The calibration mode is employed to calibrate the rim testing device and the test mode is employed during the actual testing of a rim system. The data mode allows the user to display the results of a number of tests in successive order. The auto mode is a miscellaneous mode which allows such functions as serially outputting the data through serial port 241. The mode button 240 allows a user to page sequentially through the four modes to select the desired mode.

The program memory 198 stores the programs necessary to support the selected modes. The memory 198 can also store a database of energy absorption values to be used in a comparative analysis with recently computed rim system energy absorption values.

The computing system 190 is illustrated diagrammatically in FIG. 15. The computing system 190 most preferably comprises a single microprocessor which performs all of the processing, timing, clock and memory functions. A 5100 Series microprocessor produced by Intel Corporation has be used effectively in conjunction with the invention.

The operation of the rim testing device of the present invention will now be described with reference to FIGS. 11–15. After turning "on" the device, the user first calibrates the device. The user depresses the mode button 240 to page through the various modes until the calibration mode is reached. The user rests the lower ball end 172 of the device on a hard surface such as a concrete floor and holds the device perpendicular to the hard surface. The user then preferably performs a series of three drops.

With each drop, the user moves the slide weight 160 to the top of the guide means 28. When the slide weight 160 is removed from the housing 159 and is no longer in front of the photosensor 182, the user pushes the initialize button 242 to arm the electronic circuitry in preparation for monitoring the falling and rebounding weight. Once the initialize button 242 is depressed, the display 199 shows the word "DROP" to indicate that the system is ready for a drop. The user then releases the slide weight 160. The downward moving slide weight 160 is monitored by the motion sensor 180. The weight engages the spring and is rebounded back along the path defined by the guide means. The motion sensor 180 also monitors the return trip of the slide weight. The computing system 190 computes a energy absorption value of the basketball rim system based upon the velocities of the downward falling weight and the upward moving rebounded weight (which relate to the time durations that the motion sensor detected the presence of the slide weight). At the end of a successful drop, the display 199 shows the word "OKAY".

At the end of the three drops, the computing system 190 averages the three energy absorption values resulting from the drops and displays the averaged value.

Next, the user connects the rim testing device to one of the rims to be tested. The user fastens the hook 136 over the rim. The user depresses the mode button 240 to select the test mode. The user then preferably performs a series of three drops in the same manner as described above with respect to the calibration mode. The computing system 190 adjusts the values measured during the test mode with the results obtained during calibration and then averages the three values. The averaged value is shown on display 199.

The user then proceeds to test the other basketball rim at the other end of the court in the same fashion. In this manner, both rims on the court may be adjusted to possess the same "liveliness" so that one team will not be disadvantaged over another. Further, the rim testing device permits basketball league officials to standardize all of the rims in the gyms associated with the league.

After the user has tested the rebound characteristics in the rim, the user may also employ the rim testing device to measure the height of the basketball rim. Basketball rims should rest 10 feet above the playing surface. The user extends the rod 170 from the bottom end of housing 159 (after unscrewing the handle portion), lowering the rod until the ball end 172 engages the floor under the rim. The user then views the calibration indicia on the rod with respect to the bottom edge of the housing to determine whether the rim is at its proper height.

As can be appreciated, the above described embodiments provide very portable and reliable means of determining the rebound or energy absorption characteristics of a basketball rim system. The system can be easily moved from one rim to another so the entire test of two rims of a basketball court can be quickly conducted in a period of less than 15 minutes. Such tests can be conducted repetitively having accurate results that can be easily compared to determine rebound or energy absorption characteristics and determine if the rebound or energy absorption characteristics falls within a set standard. Additionally such a unit can be manufactured and sold for a reasonable amount to fit within the operating budget of most sports facilities.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A basketball rim system testing device for testing rim rebound characteristics comprising:

impact means for applying a downward force to simulate the impact of a falling basketball striking a basketball rim;

a guide means for guiding movement of the impact means along a prescribed path;

mounting means for releasably securing the guide means and impact means to the basketball rim so that the downward force applied by the impact means is transmitted to the basketball rim to deflect the rim;

resilient means associated with the impact means for stopping downward movement of the impact means and for causing the impact means to rebound back along the prescribed path;

velocity measuring transducer for measuring the velocity of the impact means during rebound of the impact means back along the prescribed path; and computing means responsive to the measured velocity for calculating and displaying a value related to the rebound energy absorption of the basketball rim system.

2. The basketball rim testing device as claimed by claim 1 wherein the guide means is an elongated rod and wherein the impact means is a weight slidably attached to the elongated rod.

3. The basketball rim testing device as claimed by claim 1 wherein the guide means is an elongated rod and wherein the mounting means for releasably securing the guide means and impact means to the basketball rim is comprised of a hook receivable over the rim with means thereon for allowing the device to hang in a plumb orientation while releasably holding the device against elevational movement.

4. The basketball rim testing device as claimed by claim 1 wherein the guide means is an elongated rod and wherein the mounting means for releasably securing the guide means and impact means to the basketball rim is comprised of a hook receivable over the rim with a top rim engaging ball mounted thereon for tangentially engaging the rim, and means thereon for allowing the device to hang in a plumb orientation from the rim.

5. The basketball rim testing device as claimed by claim 1 wherein the guide means is an elongated hollow rod and further comprising a rim height measuring rod is slidably received within the elongated hollow rod.

6. The basketball rim testing device as claimed by claim 1 wherein the resilient means is comprised of a compression spring positioned in the prescribed path.

7. The basketball rim system testing device as claimed by claim 1 wherein:

the guide means is comprised of an elongated rod;

the impact means is comprised of a weight slidably attached to the elongated rod; and the resilient means is comprised of a compression spring operatively mounted in the path of the impact means.

8. The basketball rim system testing device as claimed by claim 1 wherein the guide means is comprised of an elongated rod having a top end and a bottom end; and further comprising:

a hook at the top end of the elongated rod for securing the rod to a basketball rim in a depending relation thereto;

an abutment surface on the bottom end of the rod member; and wherein the resilient means is comprised of a compression spring mounted to the rod and resting against the abutment surface in the prescribed path of the impact means.

9. The basketball rim system testing device as claimed by claim 1 wherein the guide means is comprised of an elongated rod having a top end and a bottom end; and further comprising:

a housing at the bottom end of the rod member;

a second rod extending from the housing to a bottom end; and a ball end at the bottom end of the second rod for tangential engagement with a floor surface.

10. The basketball rim testing device as claimed by claim 1 wherein the impact means is comprised of a slide weight and wherein the velocity measuring transducer is comprised of a reflective surface on the slide weight and a light emitting and receiving means on the guide means for emitting light toward the slide weight, for receiving a reflection of emitted light from the reflective surface, and for producing an electrical signal in response to reception of the reflection of emitted light.

11. The basketball rim testing device as claimed by claim 1 wherein the impact means is comprised of a slide weight and wherein the velocity measuring transducer is comprised of a light emitting and receiving means for emitting light toward the slide weight, for receiving a reflection of emitted light from the slide weight, and for producing an electrical signal in response to reception of the reflection of emitted light.

12. The basketball rim testing device as claimed by claim 1 wherein the velocity measuring transducer is comprised of a reflective surface on the impact means and a photosensor means on the guide means for receiving reflected light from the reflective surface on the impact means, and, in response to receiving the reflected light, producing an electrical signal related to the velocity of the impact means during rebound.

13. The basketball rim testing device as claimed by claim 1 wherein the guide means is comprised of:

a guide rod extending from a top end to a bottom end;

a sleeve mounted to and axially encircling a portion of the guide rod, and including an open top end for slidably receiving the impact means therein;

wherein the velocity measuring transducer is further comprised of:

an optical sensor mounted to the sleeve and oriented thereon to emit and receive an optical signal; and a reflective surface mounted to the impact means for reflecting the optical signal from the sensor.

14. The basketball rim testing device as claimed by claim 13 wherein the optical sensor is a photoelectric cell and the reflective surface is a light reflective surface.

15. The basketball rim testing device as claimed by claim 13 further comprising adjusting means for adjustably positioning the optical sensor a prescribed focal distance from a path of the reflective surface.

16. The basketball rim testing device as claimed by claim 1 wherein the guide means is comprised of:

a guide rod extending from a top end to a bottom end;

a sleeve mounted to and axially encircling a portion of the guide rod, and including an open top end for slidably receiving the impact means therein;

wherein the impact means is comprised of a slide weight slidably coupled to the guide rod;

wherein the velocity measuring transducer is further comprised of:

an optical sensor mounted to the sleeve at a preselected location of the prescribed path, the optical sensor being oriented on the sleeve to emit and receive an optical signal to detect presence and absence of the slide weight at the preselected location of the prescribed path.

17. The basketball rim testing device as claimed by claim 1 wherein:

the guide means includes a hollow rod; and wherein the velocity measuring transducer includes an optical sensor mounted within the hollow rod for producing and receiving an optical signal, and a reflective surface on the impact means positioned thereon to receive and reflect the optical signal from the sensor as the impact means rebounds.

18. The basketball rim testing device as claimed by claim 17 wherein the impact means is a slide weight slidably mounted to the hollow rod and wherein the reflective surface is located within a bore formed within the impact means to glidably receive the hollow rod.

19. The basketball rim testing device as claimed by claim 17 wherein the sensor is a photoelectric cell and the reflective surface is an optically reflective surface formed on the impact means.

20. The basketball rim testing device as claimed by claim 17 the impact means is a slide weight with a control bore slidably receiving the hollow rod; and wherein the sensor is a photoelectric cell.

21. A basketball rim system testing device for testing rim rebound characteristics, comprising:

a hook member receivable over a basketball rim;

a rod member having a top end mounted to the hook member and depending therefrom and a bottom end;

an abutment surface on the bottom end of the rod member;

a slide weight member mounted to the rod member above the abutment surface, freely slidable along the rod member;

resilient means between the slide weight member and the abutment surface for causing said slide weight member to rebound upwardly after being dropped along the rod member from a prescribed height;

one of said members including a pair of indicia thereon spaced apart a fixed distance longitudinally with respect to the length of the rod member;

the other of said members mounting a sensor means for detecting axial rebound movement of the pair of indicia; and velocity measuring means operably connected to the sensor means for measuring rebound velocity of the slide weight; and means for calculating and displaying a readout reflecting energy absorption of the rim system related to the rebound velocity.

22. The basketball rim testing device as claimed by claim 21 wherein the sensor is a photoelectric cell and the pair of indicia is a pair of annular reflective surfaces on the slide weight.

23. The basketball rim testing device as claimed by claim 21 wherein the sensor is a photoelectric cell and the indicia is comprised of reflective surfaces, and further comprising adjustment means for selectively adjusting focal distance between the photoelectric cell and the reflective surfaces.

24. A basketball rim system testing device, for testing rim rebound characteristics comprising:

impact means for applying a downward force to simulate the impact of a falling basketball striking a basketball rim;

a guide means for guiding movement of the impact means along a prescribed path;

mounting means for releasably securing the guide means and impact means to the basketball rim so that the downward force applied by the impact means is transmitted to the basketball rim to deflect the rim;

resilient means associated with the impact means for stopping downward movement of the impact means and for causing the impact means to rebound back along the prescribed path;

motion sensor to detect presence and absence of the impact means at a preselected position on the prescribed path as the impact means moves downward and rebounds along the prescribed path;

timing means coupled to the motion sensor for measuring time durations that the motion sensor detects the presence of the impact means; and processing means coupled to the timing means for calculating a value related to the energy absorption characteristics of the basketball rim system in accordance with the time durations measured by the timing means.

25. A basketball rim testing device as claimed in claim 24 wherein the impact means comprises a slide weight and wherein the processing means comprises a microprocessor.

26. A basketball rim testing device as claimed in claim 24 wherein the processing means uses at least two successive time durations measured by the timing means to compute the value related to energy absorption, the first time duration being measured as the slide weight moves downward along the prescribe path and the second time duration being measured as the slide weight is rebounded back along the prescribed path, the processing means calculating the value related to energy absorption in accordance with the following equation:

$$1-(\Delta t_1/\Delta t_2)^2$$

wherein $\Delta t_1$ is the first time duration and $\Delta t_2$ is the second time duration.

* * * * *